US008193469B2

(12) United States Patent
Willkens

(10) Patent No.: US 8,193,469 B2
(45) Date of Patent: Jun. 5, 2012

(54) CERAMIC IGNITERS

(75) Inventor: Craig A. Willkens, Sterling, MA (US)

(73) Assignee: Coorstek, Inc., Golden, CO (US)

( * ) Notice: Subject to any disclaimer, the term of this patent is extended or adjusted under 35 U.S.C. 154(b) by 416 days.

(21) Appl. No.: 12/069,563

(22) Filed: Feb. 11, 2008

(65) Prior Publication Data

US 2008/0314890 A1 Dec. 25, 2008

Related U.S. Application Data

(63) Continuation of application No. 10/090,468, filed on Mar. 4, 2002, now Pat. No. 7,329,837.

(60) Provisional application No. 60/273,523, filed on Mar. 5, 2001.

(51) Int. Cl.

| | |
|---|---|
| ***F23Q 7/22*** | (2006.01) |
| ***B32B 3/00*** | (2006.01) |
| ***H01B 1/04*** | (2006.01) |
| ***H01C 7/10*** | (2006.01) |

(52) U.S. Cl. ..... 219/270; 428/210; 252/516; 338/22 R

(58) Field of Classification Search ..... 219/260–270; 428/210; 252/516

See application file for complete search history.

(56) References Cited

U.S. PATENT DOCUMENTS

| | | | | |
|---|---|---|---|---|
| 5,705,261 A * | 1/1998 | Axelson | ..... | 428/210 |
| 5,820,789 A * | 10/1998 | Willkens et al. | ..... | 252/516 |
| 7,329,837 B2 * | 2/2008 | Willkens | ..... | 219/270 |

* cited by examiner

*Primary Examiner* — Daniel L Robinson
(74) *Attorney, Agent, or Firm* — David Fonda

(57) ABSTRACT

Ceramic igniters are provided that comprise at least three zones of differing electrical resistance, preferably in sequence a first conductive zone of relatively low resistance, a power booster or enhancement zone of intermediate resistance, and a further hot or ignition zone of high resistance. Igniters of the invention can provide extremely high speeds (low time-to-temperature).

5 Claims, 1 Drawing Sheet

CERAMIC IGNITERS

The present application claims the benefit of U.S. provisional application No. 60/273,523, filed Mar. 5, 2001, which is incorporated herein by reference in its entirety.

BACKGROUND

1. Field of the Invention

The present invention relates to ceramic igniter devices, and more particularly, to such devices that regions of differential electrical resistance, particularly in sequence a first conductive zone of relatively low resistance, a power enhancement zone of intermediate resistance, and a further hot or ignition zone of high resistance.

2. Background

Ceramic materials have enjoyed great success as igniters in e.g. gas-fired furnaces, stoves and clothes dryers. Ceramic igniter production includes constructing an electrical circuit through a ceramic component a portion of which is highly resistive and rises in temperature when electrified by a wire lead. See, for instance, U.S. Pat. Nos. 6,028,292; 5,801,361; 5,405,237; and 5,191,508.

Typical igniters have been generally rectangular-shaped elements with a highly resistive "hot zone" at the igniter tip with one or more conductive "cold zones" providing to the hot zone from the opposing igniter end. One currently available igniter, the Mini-Igniter™, available from Norton Igniter Products of Milford, N.H., is designed for 12 volt through 120 volt applications and has a composition comprising aluminum nitride ("AlN"), molybdenum disilicide ("$MoSi_2$"), and silicon carbide ("SiC").

A variety of performance properties are required of ceramic igniter systems, including high speed or fast time-to-temperature (i.e. time to heat from room temperature to design temperature for ignition) and sufficient robustness to operate for extended periods without replacement. Many conventional igniters, however, do not consistently meet such requirements.

Spark ignition systems are an alternative approach to ceramic igniters. See, for instance, U.S. Pat. No. 5,911,572, for a particular spark igniter said to be useful for ignition of a gas cooking burner. One favorable performance property generally exhibited by a spark ignition is rapid ignition. That is, upon activation, a spark igniter can very rapidly ignite gas or other fuel source.

In certain applications, rapid ignition can be critical. For instance, so-called "instantaneous" water heaters are gaining increased popularity. See, generally, U.S. Pat. Nos. 6,167,845; 5,322,216; and 5,438,642. Rather than storing a fixed volume of heated water, these systems will heat water essentially immediately upon opening of a water line, e.g. a user turning a faucet to the open position. Thus, essentially immediate heating is required upon opening of the water to deliver heated water substantially simultaneously with the water being turned "on". Such instantaneous water heating systems have generally utilized spark igniters. Current ceramic igniters have provided too slow time-to-temperature performance for commercial use in extremely rapid ignition applications such as required with instantaneous water heaters.

Optimally, ceramic igniters will be effective over a range of voltages. Standard ceramic igniter approval tests require operation at a range of from 85 percent to 110 percent of specified nominal voltages. Those approval tests reflect that the nominal voltage (e.g. 120 volts) delivered to a user will often vary over such a range, even through the course of a single day.

Many prior igniters have had difficulty satisfactorily performing over such an 85-110 percent range. In particular, prior igniters have had difficulty providing sufficiently fast time-to-temperature at the low end of the range (i.e. a line voltage of 85 percent of a specified nominal voltage), and have failed to provide reliable, prolonged performance at high end of the range, i.e. the igniters have prematurely degraded at high line voltages (i.e. 110 percent of a nominal voltage).

Thus, for instance, certain prior ceramic igniters systems have utilized complex electronic control apparatus in conjunction with the igniter. The control apparatus restricts the actual voltage delivered to the igniter to values to within a very narrow range of the specified nominal voltage. Such control apparatus clearly adds complexity and expense to an ignition system.

It thus would be desirable to have new ignition systems. It would be particularly desirable to have ceramic igniters that exhibited performance properties to enable use in new applications. It would be especially desirable to have new ceramic igniters with sufficiently fast time-to-temperature properties to enable use in rapid ignition applications, such as ignition source for instantaneous water heater systems.

SUMMARY OF THE INVENTION

We now provide new ceramic igniters that comprise at least three zones of differing electrical resistance, preferably in sequence a first conductive zone of relatively low resistance, a power booster or enhancement zone of intermediate resistance, and a further hot or ignition zone of high resistance.

The booster zone has a positive temperature coefficient of resistance (PTCR). Preferably, the booster has an intermediate resistance that will permit i) effective current flow to the igniter hot zone, and ii) some resistance heating of the booster region during use of the igniter, although preferably the booster zone will not heat to as high temperatures as the hot zone during use of the igniter.

It has been surprisingly found that igniters of the invention can provide extremely high speeds, including time-to-temperature of less than two seconds, and even less than about one-and-one-half seconds or about one second, at both nominal voltages and low-end line voltages (85 percent of a specified nominal voltage). See, for instance, Example 2 which follows. Thus, for the first time, ceramic igniters are provided that can replace spark ignition systems where an extremely fast time-to-temperature is required, e.g. for an ignition source for instantaneous water heating systems, cooltops, and the like.

Igniters of the invention also quite unexpectedly have exhibited quite exceptional durability, particularly in extended lifetime tests. See, for instance, Example 3 below.

Without being bound by any theory, it is believed that by having both a PTCR and an intermediate resistance, the booster zone can deliver current at high power to the hot zone as well as effectively modulate or control current delivered to the hot zone at or near the igniter's ignition temperature. It is thus believed that the exceptional time-to-temperature properties of igniters of the invention is provided by the more highly powered current delivered through the booster zone. The extended lifetime performance of the igniters of the invention is believed due at least in part to the booster zone's control or limiting of the maximum operational temperature of the igniter.

During use, the multiple zones of the igniter of the invention suitably exhibit distinct resistance and temperature values. As stated, the first conductive zone preferably exhibits the least resistance of the three zones, the booster zone a relatively higher resistance, and the hot or ignition zone exhibits the highest resistance of the igniter.

The three zones typically exhibit an analogous temperature gradient during use. That is, the conductive zone will not substantially heat during use; the hot or ignition will heat to a temperature sufficient to heat a fuel source such as at least about 1000° C., more typically at least about 1100° C., 1200° C. or 1300° C.; and the interposed booster zone will typically heat to within the range of from about at least 100, 200, 300 or 400° C. greater than the conductive zone and at least about 100, 200, 300 or 400° C. less than the hot zone.

Ceramic igniters of the invention can be employed at a wide variety of nominal voltages, including nominal voltages of 6, 8, 10, 12, 24, 120, 220, 230 and 240 volts.

The igniters of the invention are useful for ignition in a variety of devices and heating systems. More particularly, heating systems are provided that comprise a sintered ceramic igniter element as described herein. Specific heating systems include gas cooking units, heating units for commercial and residential buildings, and various heating units that require extremely fast ignition such as instantaneous water heaters. Other aspects of the invention are disclosed infra.

DETAILED DESCRIPTION OF THE INVENTION

Figure 1:
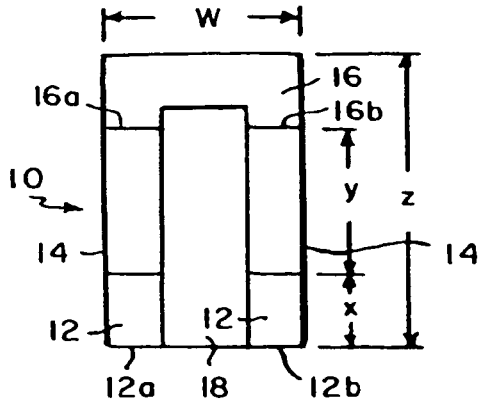
FIG. 1 depicts a preferred Igniter of the invention.

As stated above, and demonstrated in the examples which follow, sintered ceramic igniter elements are provided which can exhibit extremely fast (e.g. ≦1 or 1.5 seconds) time-to-temperature. The igniter elements of the invention contain a booster zone having a PTCR and intermediate resistance positioned in the igniter's electrical path prior to the igniter hot ignition zone.

As referred to herein, the term "time-to-temperature" or similar term refers to the time for an igniter hot zone to rise from room temperature (ca. 25° C.) to a fuel (e.g. gas) ignition temperature of about 1000° C. A time-to-temperature value for a particular igniter is suitably determined using a two-color infrared pyrometer.

Significantly, igniters of the invention can provide extremely fast time-to-temperature values even at the low-end range line voltage of a nominal voltage. That is, for example, even at 85 percent voltage of a nominal voltage, where power is significantly decreased, igniters of the invention have exhibited fast time-to-temperature values, including less than about 2 seconds or about 1.5 seconds at such low-end line voltages.

Booster zones of igniters of the invention preferably can function as a thermistor, i.e. the resistance of the booster zone increases as the booster zone operational temperature increases.

Again, without being bound by theory, it is believed that thermistor effect of the booster zone can limit the maximum ignition temperature of the hot zone and thereby increase the igniter's operational life. In other words, as the temperature of the booster zone increases, the resistance of that zone also increases, effectively limiting the amount of current delivered to the hot zone, and hence serving as a thermostat to restrict the hot zone's operational temperature, e.g. to less than about 1700° C., or less than about 1600° C., 1500° C. or 1400° C.

In preferred systems, the hot zone of an igniter of the invention will heat to: a maximum temperature of less than about 1450° C. or 1400° C., more preferably less than about 1350° C. or 1300° C. at nominal voltage; a maximum temperature of less than about 1550° C. or 1500° C., more preferably less than about 1450° C. or 1400° C. at high-end line voltages that are about 110 percent of nominal voltage; and a maximum temperature of less than about 1350° C. or 1300° C., more preferably less than about 1350° C., 1300° C. or 1250° C. at low-end line voltages that are about 85 percent of nominal voltage.

One optimal system provides a hot zone maximum temperature of from about 1250° C. to about 1300° C., preferably 1280° C. at nominal voltage; a hot zone maximum temperature of from about 1350° C. to about 1400° C., preferably 1380° C. at high-end line voltages that are about 110 percent of nominal voltage; and a hot zone maximum temperature of from about 1150° C. to about 1250° C., preferably 1200° C. at low-end line voltages that are about 85 percent of nominal voltage.

At room temperature (ca. 25° C.), the conductive zone preferably will have a resistance that is no more than about 50%, 25%, 10% or 5% of the room temperature resistance of the booster zone, and preferably the conductive zone will have a room temperature resistance that is no more than about 10%, 5% or 1% of the room temperature resistance of the booster zone. The conductive zone should exhibit minimal resistance heating during At room temperature, the booster zone preferably will have a resistance that is no more than about 75%, 50%, 25%, 10% or 5% of the hot zone. During use however, the resistance of the hot zone may suitable exceed the operational temperature resistance of the hot zone. For example, during use at operational temperatures (e.g. hot zone at least about 1000° C. or 1100° C.), the resistance of the booster zone resistance may be at least about 110%, 120%, 130%, 140%, 150%, 160%, 170%, 180%, 190%, 200%, 220%, 250%, 270% or 300% of the operational temperature resistance of the hot zone.

Although perhaps less preferred for at least some applications, the operational temperature (e.g. hot zone at least about 1000° C.) resistance of the booster zone suitably may be somewhat less than the operational temperature resistance of the hot zone, e.g. the operational temperature booster zone resistance may be no more than about 80% 70%, 60%, 50%, 40%, 30% or 20% of the operational resistance of the hot zone.

In any event however, as discussed above, preferably the resistance of the booster zone increases as the temperature of the hot zone increases.

Moreover, in preferred systems, the total resistance of the igniter element will be distributed to greater extents throughout the booster zone during use of the igniter, relative to distribution of the igniter's total resistance at room temperature. For instance, at room temperature, the hot zone typically will constitute about at least about 50 or 60 percent, or more typically about at least about 65, 70, 75, or 80 percent of the igniter's total resistance. At operational temperatures (e.g. hot zone at least about 1000° C.), the resistance of the hot zone may constitute significantly less of the total resistance of the igniter, e.g. at operational temperatures, the hot zone may constitute no more than about 50%, 40% or 30% of the total resistance of the igniter, with the booster zone constituting most of the balance of the igniter's total resistance.

Referring now to the drawings, FIG. 1 shows a preferred igniter 10 of the invention that includes conductive zones 12, adjoining power enhancement zones 14 and a hot or ignition zone 16. An insulative or heat sink region 18 may be suitably interposed in a central region of igniter 10. Such an insulating region 18 may be positioned relative to the conductive regions, power enhancement region and hot zone(s) whereby the insulator region can prevent the device from shorting (arcing). In use, wire leads are connected to ends 12*a* and 12*b* of the conductive zone to supply power to the igniter, through booster zones 14 to hot zone 16.

The dimensions of an igniter of the invention may suitably vary rather widely. For instance, the length of a preferred igniter (dimension z in FIG. 1) suitably may be from about 0.5 to about 6 cm, more preferably from about 1 to about 4 cm, and the igniter width may suitably be from about (dimension w in FIG. 1) suitably may be front about 0.2 to about 0.8 cm, more preferably from about 0.25 to about 0.5 cm.

Similarly, dimensions of the multiple zones of differing resistance also may suitably vary. Preferably, the length of conductive zone 12 (dimension x in FIG. 1) will extend above any housing in which the igniter may be mounted to prevent heating of the mounting, which can lead to degradation of the igniter. The length of booster zone 14 (dimension y in FIG. 1) suitably may be from about 0.1 to about 2 cm, more typically about 0.2 to about 1 cm, although other booster zone dimensions also will by suitable. Booster zone lengths (distance y in FIG. 1) of 0.2 to 0.5 cm will be suitable for many applications. Preferably, the path length of hot zone 12 (i.e. minimum distance from points 16*a* to 16*b*) will be at least about 0.2 cm, and up to about 2 cm or more. Generally less preferred are hot zone electrical path lengths in excess of about 2 cm, 2.25 cm or 2.5 cm.

Figure 3:
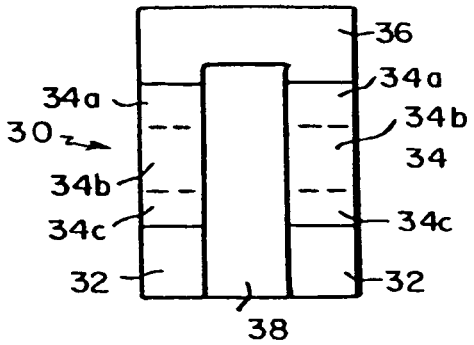
FIG. 3 shows a further suitable igniter element of the invention.
Figure 2:
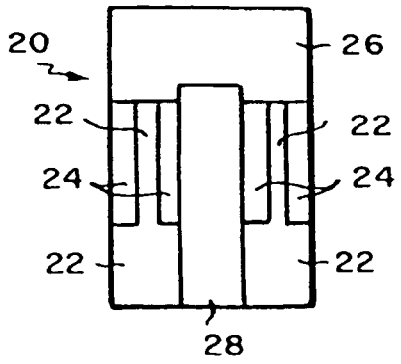
FIG. 2 shows a further igniter element of the invention.
Figure 4:
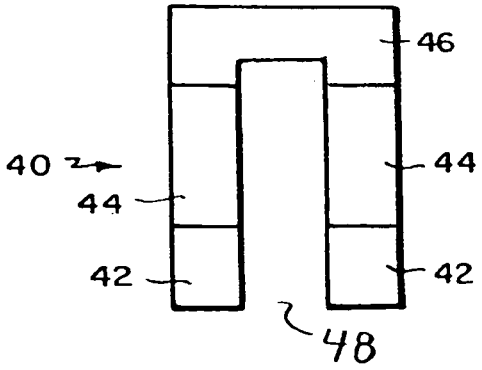
FIG. 4 shows a slotted igniter design of the invention.

FIGS. 2 through 4 show additional alternative configurations of igniters of the invention. More specifically, FIG. 2 depicts igniter 20 that includes conductive zones 22 that extend through booster zones 24 and contact hot zone 26. Such a design can enable modulating the effects of booster regions 24, e.g. the maximum operational temperature of hot zone 26 at given amperage. Such effects of booster regions 24 also can be modulated compositionally, i.e. by varying the resistance of regions 24 by the ceramic composition employed, as discussed further below.

FIG. 3 depicts a further igniter 30 of the invention, where booster zone 34 has a graded resistance, i.e. sub-zones 34*a*, 34*b* and 34*c* of booster zone 34 have differing resistance. Suitably, sub-zone 34*a* has a greater resistance than conductive zone 32, sub-zone 34*b* has a greater resistance than sub-zone 34*a*, and sub-zone 34*c* has a highest resistance within booster zone 34, but a lower resistance than the hot zone 36. Such varying resistance within booster zone 34 suitably can be accomplished by compositional differences through the zone, e.g. by a decreasing amount of a conductive material through the length of the zone. Use of a booster zone of varying resistance as exemplified in FIG. 3 can provide certain benefits, including enhanced mating of zones 32, 34 and 36, which can avoid cracking of the sintered ceramic, or other degradation of the igniter element.

FIG. 4 shows a "slotted" hairpin igniter design where instead of an interposed heat sink zone 18, 28 and 38 as shown in FIGS. 2-3 respectively, a void space 48 is interposed between conductive, booster and hot zones 42, 44 and 46.

A variety of compositions may be employed to form an igniter of the invention. Generally preferred hot zone compositions comprise at least three components of 1) conductive material; 2) semiconductive material; and 3) insulating material. Cold zones, booster zone and insulative (heat sink) regions may be comprised of the same components, but with the components present in differing proportions. Typical conductive materials include e.g. molybdenum disilicide, tungsten disilicide, nitrides such as titanium nitride, and carbides such as titanium carbide. Typical semiconductors include carbides such as silicon carbide (doped and undoped) and boron carbide. Typical insulating materials include metal oxides such as alumina or a nitride such as AlN and/or $Si_3N_4$.

For the purposes of the present invention, the term electrically insulating material refers to a material having a room temperature resistivity of at least about $10^{10}$ ohms-cm. The electrically insulating material component of igniters of the invention may be comprised solely of one or more metal oxides, or alternatively, the insulating component may contain materials in addition to the metal oxide(s). For instance, the insulating material component may additionally contain a nitride such as aluminum nitride (AlN), silicon nitride, or boron nitride; a rare earth oxide (e.g. yttria); or a rare earth oxynitride. A preferred added material of the insulating component is aluminum nitride (AlN).

For the purposes of the present invention, a semiconductor ceramic (or "semiconductor") is a ceramic having a room temperature resistivity of between about 10 and $10^8$ ohm-cm. If the semiconductive component is present as more than about 45 v/o of a hot zone composition (when the conductive ceramic is in the range of about 6-10 v/o), the resultant composition becomes too conductive for high voltage applications (due to lack of insulator). Conversely, if the semiconductor material is present as less than about 10 v/o (when the conductive ceramic is in the range of about 6-10 v/o), the resultant composition becomes too resistive (due to too much insulator). Again, at higher levels of conductor, more resistive mixes of the insulator and semiconductor fractions are needed to achieve the desired voltage. Typically, the semiconductor is a carbide from the group consisting of silicon carbide (doped and undoped), and boron carbide. Silicon carbide is generally preferred.

For the purposes of the present invention, a conductive material is one which has a room temperature resistivity of less than about $10^{-2}$ ohm-cm. If the conductive component is present in an amount of more than 25 v/o of the hot zone composition, the resultant ceramic of the hot zone composition, the resultant ceramic can become too conductive. Typically, the conductor is selected from the group consisting of molybdenum disilicide, tungsten disilicide, and nitrides such as titanium nitride, and carbides such as titanium carbide. Molybdenum disilicide is generally preferred.

In general, preferred hot zone compositions include (a) between about 50 and about 80 v/o of an electrically insulating material having a resistivity of at least about 1010 ohm-cm; (b) between about 5 and about 45 v/o of a semiconductive material having a resistivity of between about 10 and about $10^8$ ohm-cm; and (c) between about 5 and about 25 v/o of a metallic conductor having a resistivity of less than about $10^{-2}$ ohm-cm. Preferably, the hot zone comprises 50-70 v/o electrically insulating ceramic, 10-45 v/o of the semiconductive ceramic, and 6-16 v/o of the conductive material. A specifically preferred hot zone composition for use in igniters of the invention contains 10 v/o $MoSi_2$, 20 v/o SiC and balance AlN.

As discussed, igniters of the invention contain a relatively low resistivity cold zone region in electrical connection with the booster and hot zones and which allows for attachment of wire leads to the igniter. Preferred cold zone regions include those that are comprised of e.g. AlN and/or $Al_2O_3$ or other insulating material; SiC or other semiconductor material; and $MoSi_2$ or other conductive material. However, cold zone regions will have a significantly higher percentage of the conductive and semiconductive materials (e.g., SiC and $MoSi_2$) than the hot zone. A preferred cold zone composition comprises about 15 to 65 v/o aluminum oxide, aluminum nitride or other insulator material; and about 20 to 70 v/o $MoSi_2$ and SiC or other conductive and semiconductive material in a volume ratio of from about 1:1 to about 1:3. For many applications, more preferably, the cold zone comprises about 15 to 50 v/o AlN and/or $Al_2O_3$, 15 to 30 v/o SiC and 30 to 70 v/o $MoSi_2$. For ease of manufacture, preferably the cold zone composition is formed of the same materials as the hot zone composition, with the relative amounts of semiconductive and conductive materials being greater.

A specifically preferred cold zone composition for use in igniters of the invention contains 20 to 35 v/o $MoSi_2$, 45 to 60 v/o SiC and balance either AlN and/or $Al_2O_3$. Another specifically preferred cold zone composition for use in igniters of the invention contains 20 to 35 v/o $MoSi_2$, 40 v/o SiC and balance either AlN and/or $Al_2O_3$. Another preferred cold zone composition for use in igniters of the invention contains 30 v/o $MoSi_2$, 40 v/o SiC and balance either AlN. Generally preferred cold zone compositions contain 20 to 35 v/o $MoSi_2$, at least 40 v/o SiC and balance either AlN and/or $Al_2O_3$.

Preferred booster zone compositions may comprise the same materials as the conductive and hot zone region compositions, e.g. preferred booster zone compositions may comprise e.g. AlN and/or $Al_2O_3$, or other insulating material; SiC or other semiconductor material; and $MoSi_2$ or other conductive material. A booster zone composition typically will have a relative percentage of the conductive and semiconductive materials (e.g., SiC and $MoSi_2$) that is intermediate between the percentage of those material in the hot and cold zone compositions. A preferred booster zone composition comprises about 60 to 70 v/o aluminum nitride, aluminum oxide, or other insulator material; and about 10 to 20 v/o $MoSi_2$ or other conductive material, and balance a semiconductive material such as SiC. A specifically preferred booster zone composition for use in igniters of the invention contains 14 v/o $MoSi_2$, 20 v/o SiC and balance v/o $Al_2O_3$. A specifically preferred booster zone composition for use in igniters of the invention contains 17 v/o $MoSi_2$, 20 v/o SiC and balance $Al_2O_3$. A further specifically preferred booster zone composition for use in igniters of the invention contains 14 v/o $MoSi_2$, 20 v/o SiC and balance v/o AlN. A still further specifically preferred booster zone composition for use in igniters of the invention contains 17 v/o $MoSi_2$, 20 v/o SiC and balance AlN.

As discussed above, igniters of the invention may suitably comprise a non-conductive region, typically interposed between conductive and booster regions, as exemplified by heat sink regions 18, 28 and 38 of FIGS. 1 through 3 respectively. Preferably, a sintered insulator region has a resistivity of at least about $10^{14}$ ohm-cm at room temperature and a resistivity of at least $10^4$ ohm-cm at operational temperatures and has a strength of at least 150 MPa. Preferably, an interposed insulator region has a resistivity at operational temperatures that is at least 2 orders of magnitude greater than the resistivity of the hot zone region. Suitable insulator compositions comprise at least about 90 v/o of one or more aluminum nitride, alumina and boron nitride. A specifically preferred insulator composition of an igniter of the invention consists of 60 v/o AlN; 10 v/o $Al_2O_3$; and balance SiC. Another preferred heat composition for use with an igniter of the invention contains 80 v/o AlN and 20 v/o SiC.

The processing of the ceramic component (i.e. green body and sintering conditions) and the preparation of the igniter from the densified ceramic can be done by conventional methods. Typically, such methods are carried out in substantial accordance with methods disclosed in U.S. Pat. No. 5,786,565 to Wilkens and U.S. Pat. No. 5,191,508 to Axelson et al.

Briefly, two separate sintering procedures can be employed, a first warm press, followed by a second high temperature sintering (e.g. 1800 or 1850° C.). The first sintering provides a densification of about 55 to 70% relative to theoretical density, and the second higher temperature sintering provides a final densification of greater than 99% relative to theoretical density.

The igniters of the present invention may be used in many applications, including gas phase fuel ignition applications such as furnaces and cooking appliances, baseboard heaters, boilers, and stove tops. In particular, an igniter of the invention may be used as an ignition source for stop top gas burners as well as gas furnaces.

As discussed above, igniters of the invention will be particularly useful where rapid ignition is beneficial or required, such as in ignition of a heating fuel (gas) for an instantaneous water heater and the like. Indeed, igniters of the invention provide extremely fast time-to-temperature performance, including time-to-temperatures values of less than 3 or 2 seconds, and even less than 1.5 seconds and one seconds.

Igniters of the invention also are particularly suitable for use for ignition where liquid fuels (e.g. kerosene, gasoline) are evaporated and ignited, e.g. in vehicle (e.g. car) heaters that provide advance heating of the vehicle.

The following non-limiting examples are illustrative of the invention. All documents mentioned herein are incorporated herein by reference in their entirety.

EXAMPLE 1

An igniter of the invention was prepared as follows.

Hot zone, intermediate resistance power enhancement zone and electroconductive cold zone compositions were prepared. The hot zone composition comprised 70 parts by volume AlN, 10 parts by volume $MoSi_2$ and 20 parts by volume SiC, which were blended in a high shear mixer. The intermediate power enhancement zone comprised about 15 parts by volume AlN, about 40 parts by volume $MoSi_2$ and about 45 parts by volume SiC, which were blended in a high shear mixer. The electrically conductive cold zone composition comprised about 20 parts by volume of $MoSi_2$, 20 parts by volume AlN, and balance SiC, which were blended in a high shear mixer.

A billet of alternating zones of power enhancement composition and hot zone composition was prepared by warm pressing alternating compositions. A billet of electroconductive cold zone composition was prepared by warm press. The electroconductive cold zone composition billet and the billet comprising alternating layers of the power enhancement composition and hot zone composition were sliced to form 0.100 inch duck tiles. The billet comprising alternating layers of the power enhancement electrically insulating cold zone composition and hot zone composition was sliced perpendicular to the direction of layering the alternating compositions such that the tiles comprise alternating zones of the power enhancement composition and hot zone composition.

A three tile stack comprising a outer tile that comprise conductive zone, booster zone and hot zone compositions that sandwich a tile that comprise heat sink and hot zone compositions. The stack of tiles was pressed by hot isostatic press. Igniter elements were prepared by slicing the pressed stack of tiles perpendicular to both the stacking direction of the tiles and the orientation of the alternating layers of electrically insulating cold zone composition and hot zone composition in the middle tile.

EXAMPLE 2

Time-to-Temperature Tests

An igniter element produced as described in Example 1 was tested as follows.

Leads were attached to the attached to the conductive portions of the igniter and a voltage of 24 nominal voltage. The igniter displayed stable heating performance and reached the design temperature of 1100° C. in less than 1 second, as determined using a 2-color infrared pyrometer.

The same results were achieved using additional igniters of the invention.

EXAMPLE 3

Operational Life Tests

An igniter produced as described in Example 1 above was tested in an operational life test as follows. The igniter was heated at hot zone operational temperature of about 1230 for 100 consecutive hours and at 24 volts, power was turned off, and the 100 hour continuous heating was repeated several times. The igniter operational temperature, amperage and time-to-temperature values remained essentially constant throughout the heating cycles.

The same results were achieved using additional igniters of the invention.

The invention has been described in detail with reference to particular embodiments thereof. However, it will be appreciated that those skilled in the art, upon consideration of this disclosure, may make modification and improvements within the spirit and scope of the invention.

What is claimed is:

1. A sintered ceramic heating element comprising a conductive zone, a power booster zone, and a hot zone, the booster zone having a PTCR and a resistivity greater than the conductive zone and less than the hot zone, the room temperature resistance of the conductor zone being less than about 50 percent of the room temperature resistance of the booster zone and the room temperature resistance of the booster zone is less than about 70 percent of the room temperature resistance of the hot zone.

2. A heating element of claim 1 wherein the resistance of the booster zone permits i) current flow to the igniter hot zone and ii) resistance heating of the booster region during use of the igniter.

3. A heating element of claim 1 wherein the resistance of the booster zone increases during application of current through the igniter and heating of the booster zone.

4. A heating element of claim 1 wherein the resistance of the booster zone at operational temperatures is at least about 110% of the operational temperature resistance of the hot zone.

5. A heating element of claim 1 wherein the resistance of the booster zone at operational temperatures is no more than about 80% of the operational temperature resistance of the hot zone.

* * * * *